United States Patent [19]

Love

[11] Patent Number: 4,933,991

[45] Date of Patent: Jun. 19, 1990

[54] COMBINATION DRESS SHIRT AND TIE

[76] Inventor: Terry J. Love, 1116 Forrest St., Baltimore, Md. 21202

[21] Appl. No.: 239,709

[22] Filed: Sep. 2, 1988

[51] Int. Cl.[5] ..... A41B 1/00; A41D 25/00

[52] U.S. Cl. ..... 2/115; 2/118; 2/130; 2/244; D2/209; D2/215

[58] Field of Search ..... 2/103, 115, 113, 118, 2/130, 144, 244, 246; D2/212, 214, 215, 81, 79; 40/586

[56] References Cited

U.S. PATENT DOCUMENTS

| | | | |
|---|---|---|---|
| 433,732 | 8/1890 | Horstmann | 2/79 X |
| 1,259,244 | 3/1918 | Kerstetter | 2/130 |
| 2,647,262 | 8/1953 | Crothers | 2/130 X |
| 2,709,813 | 6/1955 | Clendenin, Jr. | 2/130 |
| 3,230,547 | 1/1966 | Moran, Jr. | 2/103 X |
| 4,466,136 | 8/1984 | Bottom et al. | 40/586 X |
| 4,494,285 | 1/1985 | Burkhead et al. | 2/2.1 R X |

FOREIGN PATENT DOCUMENTS

| | | | |
|---|---|---|---|
| 1089362 | 5/1986 | Japan | 2/246 |

OTHER PUBLICATIONS

"Mellow Mail" Catalogue; pp. 6 and 7.

*Primary Examiner*—Werner H. Schroeder
*Assistant Examiner*—Jeanette E. Chapman
*Attorney, Agent, or Firm*—Leonard Bloom

[57] ABSTRACT

A unitary article of apparel includes a shirt portion having a dyed portion thereon. The dyed portion is in the shape of a tie, so as to create a combination shirt and tie. This combination is machine washable. The dyed portion has a fastener means formed therein which permits the shirt portion to be opened and closed (as desired) for use as casual wear or formal wear, respectively. In one embodiment, the dye comprises a "puffed" ink dye, thereby providing a three-dimensional effect and contributing to the realism.

7 Claims, 4 Drawing Sheets

COMBINATION DRESS SHIRT AND TIE

FIELD OF THE INVENTION

The present invention relates to articles of apparel and, in particular, a unitary shirt and tie for a man or boy.

BACKGROUND OF THE INVENTION

The desirability of providing a unitary, article of apparel wherein a shirt and a conventional "four-in-hand" tie are combined is well known. Many people find such unitary articles of apparel to be more comfortable to wear because, for example, there is no tying or untying of the tie, especially in hot weather. Such unitary articles of apparel also permit the wearer thereof to utilize the shirt or garment for both formal and leisure occasions and are easily convertible from one use to the other simply by unbuttoning and/or buttoning the shirt to obtain the desired opening. Also, since the tie is inseparable from the shirt, there is no risk of the tie becoming lost, which is a problem often encountered with, for example, school children. In this respect, such unitary articles of apparel save money which otherwise may have to be spent purchasing replacement ties.

There have been several proposals for providing such unitary articles of apparel wherein a man's shirt and tie are combined. Those proposals, of which I am aware, are as follows:

| Inventor(s) | Patent No. | Year of Issue |
|---|---|---|
| Dean | 43,068 | 1864 |
| Broom | 458,266 | 1891 |
| Drumm | 2,090,724 | 1937 |
| Black | D 155,381 | 1949 |
| Crothers | 2,647,262 | 1953 |
| Clendenin, Jr. | 2,709,813 | 1955 |
| Chambon | 3,151,332 | 1964 |
| Artz, Sr. | 3,628,192 | 1971. |

Each of the above references involves the use of additional pieces of material for the tie portions thereof, which additional material is sometimes secured to the shirt portion by, for example, sewing. While providing a suitable shirt and tie that are combined in a unitary article of apparel, such an arrangement is nonetheless expensive in that it requires the use of additional material for simulating the tie, as well as the use of time, machinery and labor for attaching the tie to the shirt. Also, it can be weighty and uncomfortable to wear, especially in hot summer months.

In an attempt to eliminate this extra material and expense, Clendenin, Jr. '813 proposes the provision of a shirt having a collar with a bow tie simulated thereon. In this arrangement, the knot of the bow is simulated by a fastening element. The remainder of the bow tie is simulated by small patches or patch-like elements of additional material. When the neck band of this shirt is closed, the patches are adjacent to the fastener, such that a complete bow tie is simulated.

While eliminating the need for large quantities of additional material, the apparel of Clendenin, Jr. '813 still requires the use of additional material for the patches and further requires the additional labor and machinery required for securing such patches. Also, this arrangement is only suitable for simulating narrow bow ties and is not readily adaptable for simulating neckties or bow ties having large knots.

Moreover, dying a portion of the shirt, so that the dyed portion simulates a tie has never been possible because of the presence of buttons or other fastening means on the shirt which would interfere with the dying process.

Thus, it can be seen that there remains a need for a single unitary article of apparel which simulates a man's or boy's shirt and tie without the use of any fabric or material for simulating the tie. There also remains a need for a dying process which can dye portions of an article of apparel which has buttons or other fastening means thereon.

To the best of my knowledge and belief, the prior art references (noted above) have never been commercialized to any widespread effect, nor is a solution to this particular problem (of long standing) available on the open market at the present time.

SUMMARY OF THE INVENTION

Accordingly, it is a primary object of the present invention to alleviate the disadvantages and deficiencies of the prior art by providing a unitary article of apparel that simulates a shirt and a tie, thereby providing the illusion that the person is actually wearing a tie.

It is another object of the present invention to provide a unitary article of apparel that simulates a shirt and tie without the use of extra material.

It is still another object of the present invention to provide a process for dying a portion of an open front shirt, such that the dyed portion simulates a tie.

It is a still further object of the present invention to provide a process for dying a portion of an open shirt front having buttons thereon, such that the dyed portion simulates a tie.

In accordance with the teachings of the present invention, there is herein disclosed a shirt portion suitably sized for being received over a human torso. The shirt portion has a neck opening formed therein for permitting a human neck to pass therethrough, and further has a front. The shirt portion still further has a dyed portion; and the dyed portion is positioned on the front of the shirt portion substantially adjacent to the neck opening, such that the neck opening is at least partially bounded by the dyed portion. The dyed portion further extends substantially downwardly from the neck opening, whereby a unitary shirt having a tie simulated thereon is formed.

In accordance with the further teachings of the present invention, the neck opening is bounded by a neck band, and a collar is positioned on the neck band. This collar has a pair of ends which are positioned in spaced opposed relation to one another. The shirt portion and the neck band each has a dyed portion. The dyed portion extends between the ends of the collar and downwardly therefrom, whereby a unitary shirt having a tie simulated thereon is formed.

In a preferred embodiment, the front of the shirt also has an opening formed therein, whereby an open front shirt is formed. In this embodiment the dyed portion extends downwardly on both sides of the opening on the front of the shirt.

It is further preferred to include a means for closing the neck band and/or the opening formed in the front of the shirt. It is particularly preferred for this fastening means to include buttons.

Viewed in another aspect, the present invention provides the combination of a shirt having a collar and further having a front buttoned portion beneath the collar. A tie is printed on the front buttoned portion of the shirt, and this printed tie has respective portions extending beneath the collar of the shirt; such that when the collar is opened, the appearance or illusion of a tie is maintained.

Preferably, the tie is printed with a "puffed" ink (such as "PLASTISOL" ink), thereby providing a three-dimensional effect and contributing to the realism of the combination. In another embodiment, the "puffed" ink comprises respective spaced-apart portions, thereby providing the illusion of a "regimental" striped tie.

Viewed in still another aspect, the present invention provides a method of creating the illusion of a tie on a shirt. The improved method includes the step of providing a shirt having a collar portion, wherein the collar portion may be loosened to provide an open collar. The design of a tie is printed directly on the shirt, such that the design includes respective portions extending beneath the and such that the illusion of a tie is preserved even the collar is loosened.

These and other of the present invention will become apparent from a reading of the following specification, taken in conjunction with the enclosed drawings.

DESCRIPTION OF THE PREFERRED EMBODIMENTS

Figure 1:
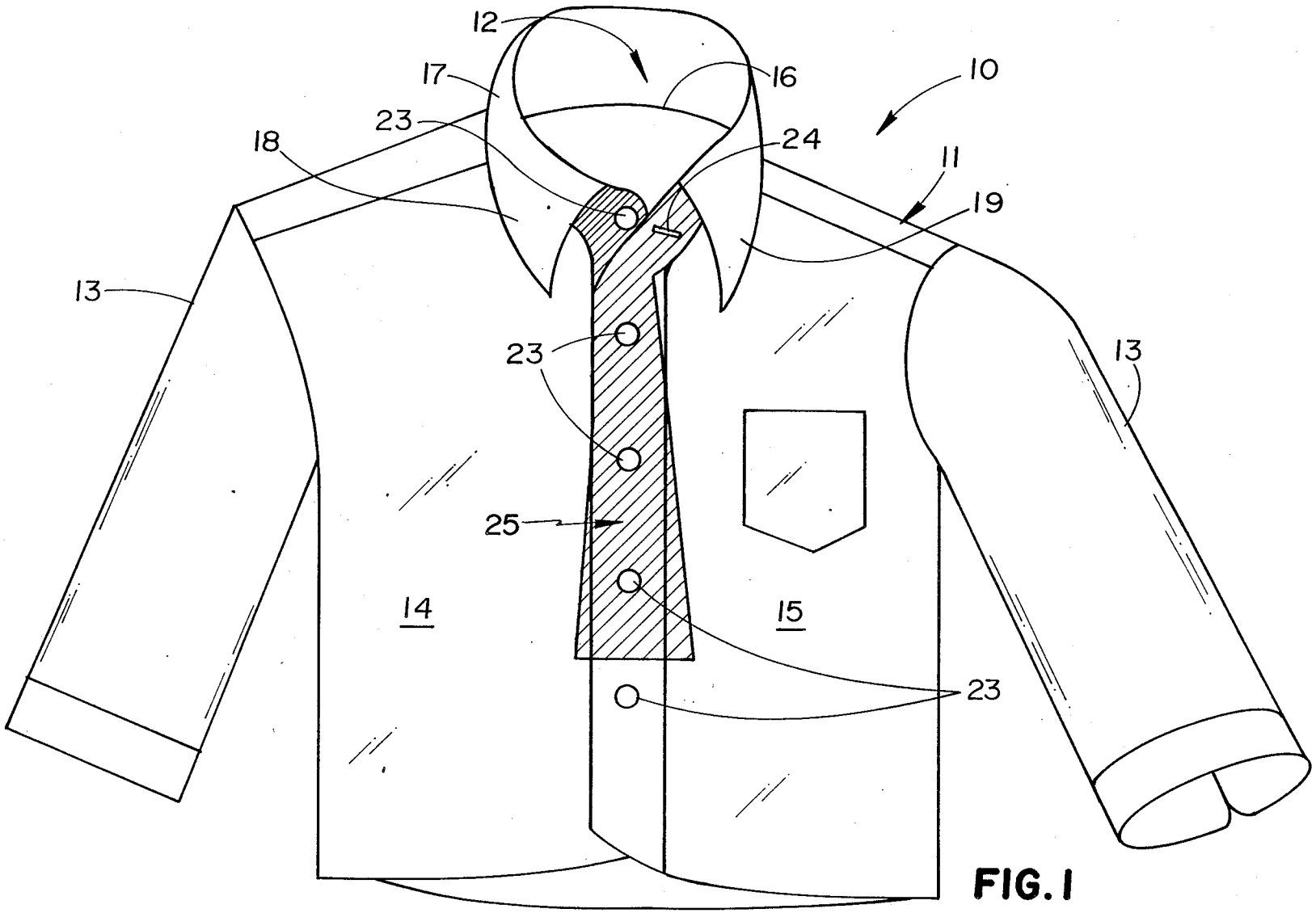
FIG. 1 is a perspective view illustrating the appearance of the unitary article of apparel, worn as a sport shirt.
Figure 2:
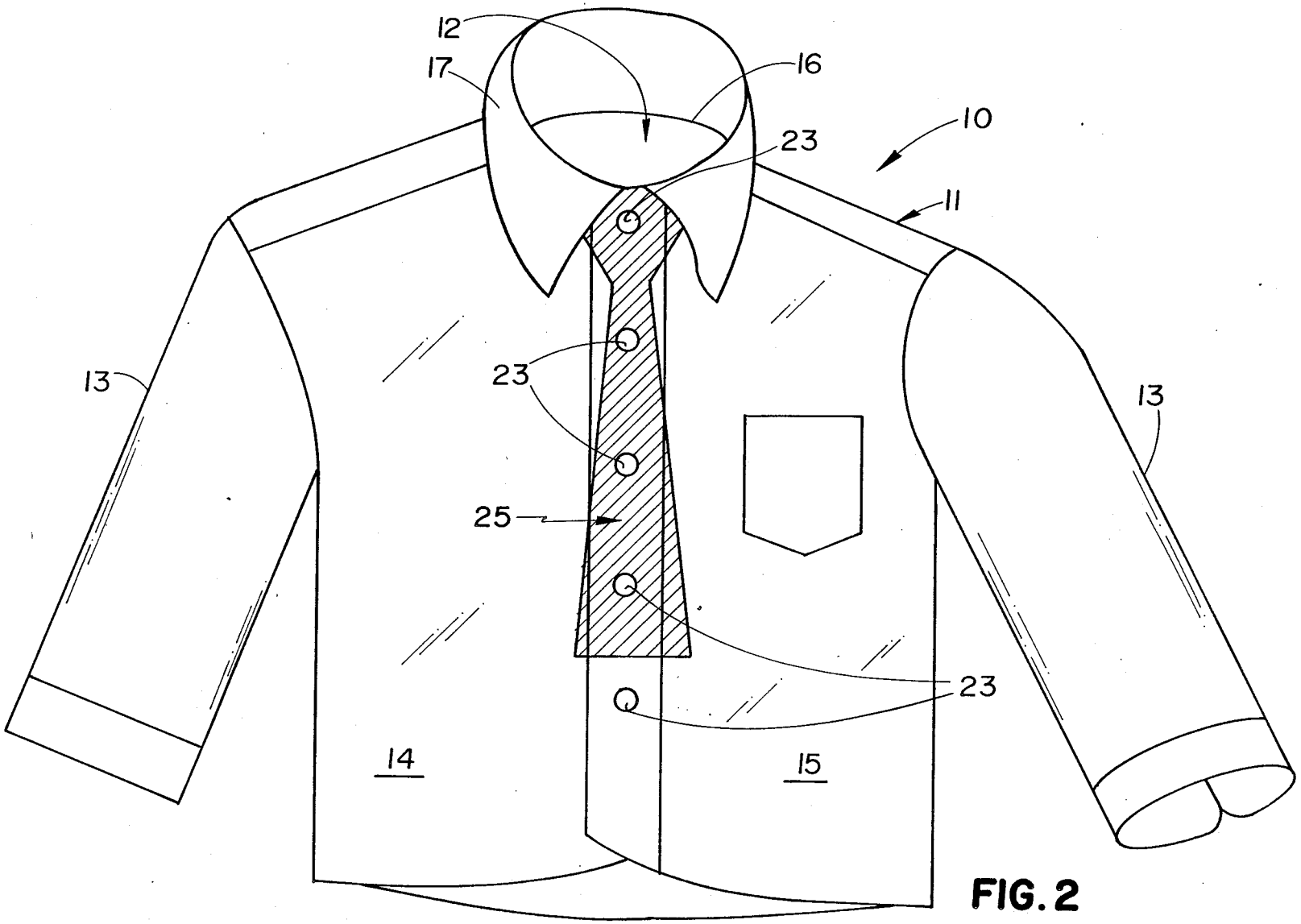
FIG. 2 is a perspective view illustrating the appearance of the unitary article of apparel, worn as a formal shirt with a tie simulated thereon.
Figure 3:
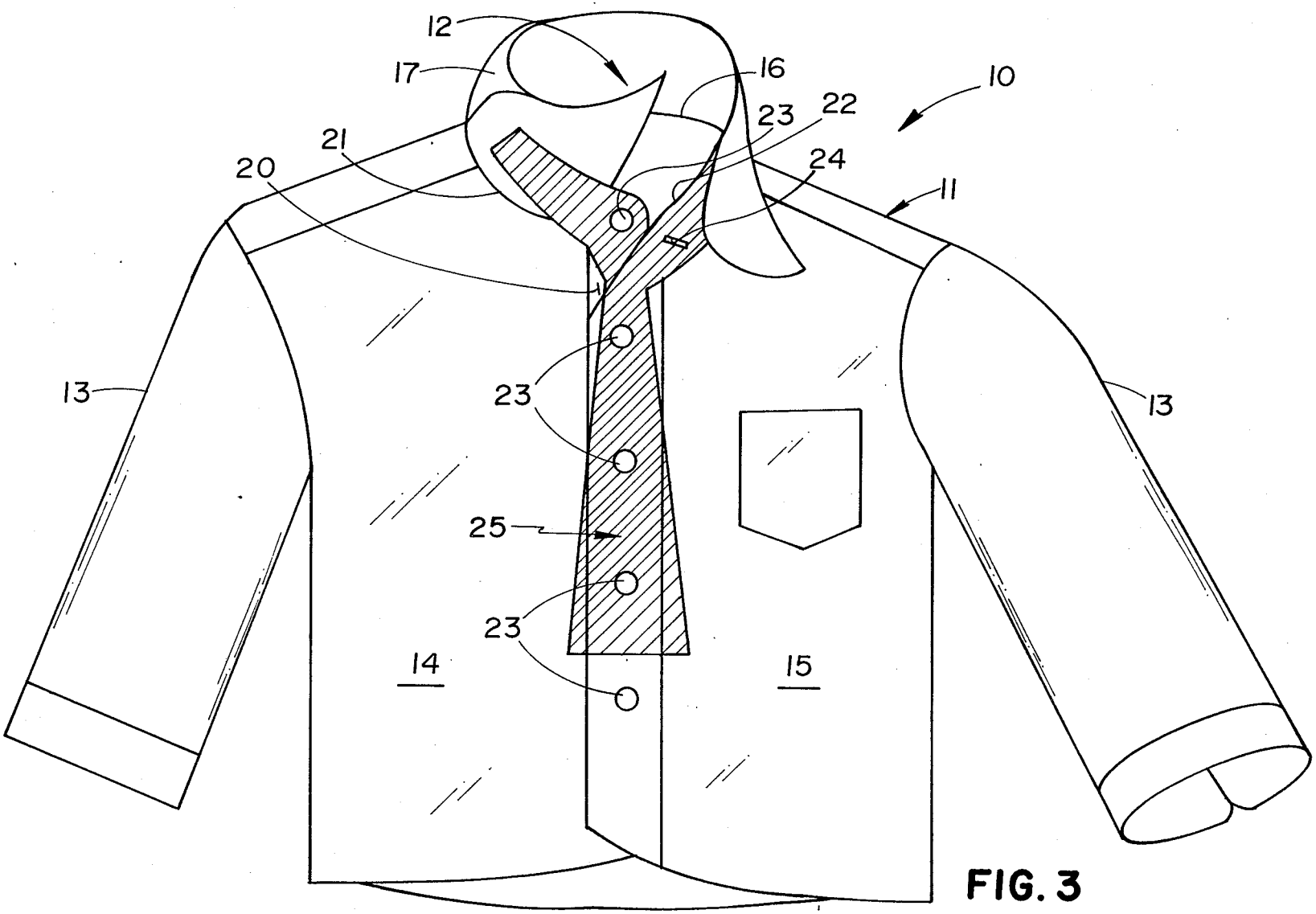
FIG. 3 is a perspective view of the apparel with the collar thereof partially turned up to show the dyed portion underneath.

With reference to the drawings, more particularly FIGS. 1–3, the unitary article of apparel 10 simulates a shirt and a tie. The apparel 10 includes a shirt portion 11 which is sized to be received over a human torso. A neck opening 12 is formed in the shirt portion 11 for permitting a human neck to pass therethrough. A pair of sleeves 13 are provided on either side of the shirt portion 11, being positioned on opposite sides of the neck opening 12. the shirt portion 11 and the sleeves 13 have respective arm openings formed therein (not shown herein) for permitting human arms to pass therethrough.

If desired, the shirt portion 11 may be open at the front defining separable front shirt portions 14 and 15.

The neck opening 12 is bounded by a neck band 16. Secured about the neck band 16 is a collar 17 which has a pair of collar ends 18 and 19, respectively. These collar ends 18 and 19 are spaced apart in an opposed relation to one another. These collar ends 18 and 19 may be pointed, rounded off, or shaped in any other manner as is desired by the user and/or as is determined by fashion.

A portion 20 of the shirt portion 11 extends between the collar ends 18 and 19. If the shirt is of the type that has an open front, then the neck band 16 will likewise be open, having a pair of end portions 21 and 22, that are aligned, respectively, with the edges of the front shirt portions 14 and 15. Also, the portion 20 of the shirt portion 11 extends on both sides of the open front with a respective collar end 18 and 19 being positioned on a respective side of the opening lying adjacent to the neck band end portions 21 and 22, respectively. In this manner, the opening in the neck band 16 is substantially aligned with the opening in the front of the shirt portion 11, thereby forming a single continuous opening.

Fastening means is provided for securing the edges 14 and 15 of the shirt portion to one another and for securing the end portions 21 and 22 of the neck band 16 to one another. In this manner, the open front of the shirt may be selectively closed. When the open front is closed, end 14 underlies end 15; and end portion 21 underlies end portion 22. Any suitable fastening means, such as "VELCRO" fasteners, an interchangeable snap clasp elements, or button studs (to name but a few) may be employed for holding the front shirt portions 14 and 15 and the edges 21 and 22 of the neck band in a closed position or condition.

However, it is preferred to utilize conventional buttons 23 and button holes 24. Accordingly, end portions 15 and edge 22 have respective button holes 24 formed therein (on one side of the neck band opening and on one side of the open front of the shirt portion 11) and end portion 14 and edge 21 have respective buttons positioned or disposed thereon (on the other side of the neck band opening and on the other side of the open front of the shirt portion 11). In this manner, as will be readily understood by those skilled in the art, the buttons 23 removably mate with a respective button hole 24, thereby closing the open front and the neck band.

If desired, the buttons 23 and button holes 24 (or other fastening means) may be of the variety referred to as "hidden". "VELCRO" and zipper fastener means are specifically well adaptable for use in this "hidden" arrangement. Such an arrangement further helps in creating a more realistic simulation of an actual tie by removing the tell-tale fastening means from view.

The shirt portion 11 further includes a dyed portion 25. This dyed portion 25 at least extends between the collar ends 18 and 19 and downwardly therefrom. This dyed portion 25 is shaped, on the portion 20 extending between the collar ends 18 and 19 and further extending downwardly therefrom, such that when the shirt portion 11 and the neck band 16 is closed, a tie is simulated; and so that when the neck band 16 is open, it looks like the tie is under the collar.

Because there is no extra material needed to form the simulated tie, the dyed area can be made to be virtually any size, shape, color or ornamentation. Hence, shirts 10 having either bow ties or neckties (large and small) may be formed.

Also, it is noted that if one desires ornamentation or particular dyes (such as puffed dyes) or inks may be utilized so as to add depth or bulk to the tie. An example of such ink is a puffed ink dye. Such ornamentation or dyes gives the tie a three-dimensional effect, adding to the realism and illusion thereof. They are also "fast" and the colors thereof do not run. Thus, any spills or stains thereon may be readily removed therefrom, using conventional home laundry equipment.

If desired, the dyed portion 25 may also further extend upwardly past the ends of the collar 18 and 19 and underneath the collar 17, as shown more clearly in FIG. 3. Such an arrangement helps to complete the illusion that the person is wearing a traditional tie. Further, if desired, a second dyed portion may be formed (not illustrated) on the internal collar surface to permit the continued use of the shirt if and when the collar 17 is turned up.

Finally, it is noted that the dyed portion 25 extends both between the ends 18 and 19 of the collar 17 and along the opening in the neck band 16 and in the front of the shirt portion 11. In doing so, the dyed area extends over that portion of the shirt where the fastening means are located. Accordingly, it further preferred that each of the fastener means, whether they be "VELCRO", studs or buttons be dyed the same color as the dyed portion 25, such that when the open front of the shirt portion 11 and the neck band 16 are in the closed condition, a tie is simulated on the shirt.

Obviously, many modifications of the unitary article of apparel described above may be made. For example, it is possible to omit the neck band 16 and/or the collar 17 and still form the dyed portion 25 thereon so as to simulate a tie on, for example, a tee shirt. However, for the most realistic simulation, the neck band 16 and the collar 17 are desired.

Having thus described the unitary article of apparel 10 which simulates a shirt and tie combination, the process of forming the dyed portion 25 onto the shirt portion 11 will now be disclosed.

The shirts utilized in this invention may be any ordinary shirt with or without a collar. These shirts are readily available in any apparel store. Where no fastening means are employed, traditional silk screening, tie-dying or puffed ink dying processes may be employed to form the dyed portions 25 on the shirt portions 11.

However, the presence of several different types of fastening means (and, in particular, buttons) can offer a resistance to an ordinary squeegee employed in silk screening. Therefore, where such fastening means are present (such as the buttons which are present on most shirts) a new approach to silk screening the image is desirable. The following are involved in this approach: (1) that a different type of squeegee be utilized; (2) that a carrier other than silk be utilized; and (3) that a flexible union between the fabric and the holder be employed.

Thus, by using the process of the present invention, a unitary article of apparel that simulates a shirt and tie is provided. The apparel is advantageous in that: (1) there is no other such combination shirt and tie in existence where no additional fabric is utilized; (2) the tie is inseparable from the shirt, eliminating the risk of loss thereof; (3) it speeds up dressing in that no tying or untying of a tie is necessary; (4) it is more comfortable to wear, being easily convertible from formal wear to casual wear by simply unbuttoning or buttoning the desired opening; and (5) it saves money by reducing the fabrication costs thereof.

It is also noted that the process of the present invention may also be utilized to form other neckties and cravats, such as bow ties, as well as other articles of apparel. For example, shoe laces may be formed on shoes; and designs and writings may be made on scarves and bandannas.

Figures 4, 5, 6:
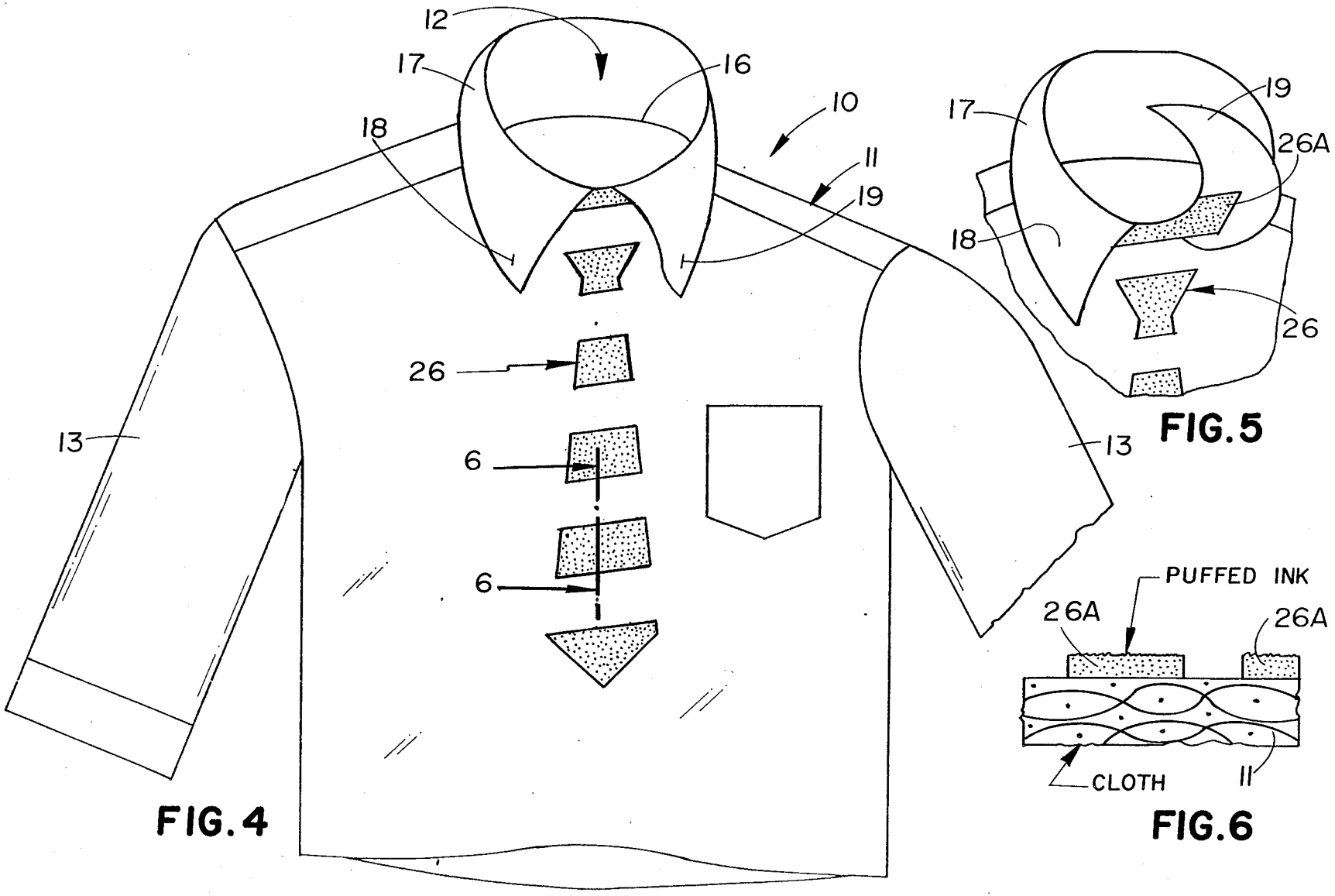
FIG. 4 corresponds substantially to that of FIGS. 1–3, but illustrates an alternate embodiment of the present invention wherein a "puffed" ink is used to create a three-dimensional effect, thereby further providing the illusion that the person is actually wearing a tie.
FIG. 5 corresponds to a portion of FIG. 4, but illustrates that the puffed ink extends (at least partially) below the shirt collar; so that when the collar is unbuttoned and opened, the illusion of the necktie is maintained.
FIG. 6 is a cross-sectional view, taken along the lines 6—6 of FIG. 5 and drawn to an enlarged scale, and further showing how the puffed ink is disposed on the shirt in spaced-apart sections (arranged inclined as shown in FIG. 4) to thereby create the illusion of a striped "regimental" type of tie.

With reference to FIGS. 4–6, the dyed portion of the shirt comprises a plurality of respective spaced-apart "puffed" ink portions 26. These puffed ink portions 26 may be slightly inclined, and of variable length and/or width, so as to create the desired three-dimensional illusion of a "regimental" striped tie, as shown more clearly in FIG. 4. It will be appreciated by those skilled in the art, however, that any particular tie design may be used to create the desired illusion, consonant with the teachings of the present invention.

The simulated striped tie, with its series of puffed ink portions 26, includes a portion 26A extending below the collar end portions 18 and 19, respectively, as shown more clearly in FIG. 5. Accordingly, the illusion of wearing a tie will be preserved, even though the top button (or other fastener) is loosened and the collar is opened.

With reference to FIG. 6, the spaced-apart puffed ink portions 26 are applied directly to the applicable front portions of the shirt 11. The spacing between the puffed ink portions 26 may be varied, as desired.

The "puffed" inks are well known to those skilled in the art. The ink or paint may be a suitable acrylic contained in a tube, while the "puff" is contained in another tube. These tubes of material are readily available on the open market. Desired respective quantities of paint and puff may be mixed in a suitable container, such as a saucer, and the mixture may be diluted with water to make it thinner, if desired. The mixture is applied to the shirt, artistically to create the desired design and illusion, and the design on the shirt is allowed to dry. When dried, heat is applied for curing the mixture, thereby causing the design to rise up or "puff". The heat is applied by an electric iron (through a suitable paper or cloth) or in an oven.

The process, as described above, is for making individual samples or prototype models of the desired "puffed" ink designs. It will be appreciated, of course, that in the manufacture of production quantities, the "puffed" ink process would be suitably automated to increase production and reduce unit costs, thereby making the improved shirt-and-tie combinations of the present invention readily available for widespread consumer purchase through existing channels of merchandising and distribution.

Moreover, the teachings of the present invention are equally applicable to all types of shirt-and-tie combinations for men and boys, as well as all types of shirts (including sport shirts), and as well as blouse-and-tie or blouse-and-scarf combinations for women and girls.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. The combination of a dress shirt and a tie, wherein the illusion of a conventional tie is provided, and wherein the illusion is maintained even when the dress shirt is opened, comprising a conventional dress shirt that may be readily laundered, the shirt having a front portion and further having a neck band portion including a collar that may be buttoned or left open, as desired by the wearer, a tie fixed in position on the front portion of the shirt and extending downwardly from the collar of the shirt, thereby providing the illusion of a conventional tie, the tie including respective integral portions which extend beneath the collar of the shirt from the front portion thereof and at least partially around the neck band portion thereof, thereby maintaining the illusion of a conventional tie even though the collar of the shirt is opened by the wearer, and wherein the front portion of the shirt includes respective portions which are held together by fastening means, the fastening means being disposed beneath the tie and being hidden externally of the wearer, thereby avoiding any interference with the tie on the front portion of the shirt.

2. The combination of claim 1, wherein the fastening means comprises respective hook-and-loop fasteners.

3. The combination of claim 1, wherein the tie is printed on the front portion of the shirt.

4. The combination of claim 3, wherein the tie is printed by "puffed" ink, thereby providing a three-dimensional effect.

5. The combination of claim 4, wherein the "puffed" ink tie comprises alternate spaced-apart sections separated by the front portion of the shirt, thereby simulating a regimental stripped tie.

6. The combination of a dress shirt and a tie, wherein the illusion of a conventional tie is provided, and wherein the illusion is maintained even when the dress shirt is opened, comprising a conventional dress shirt that may be readily laundered, the shirt having a front portion and further having a neck band portion including a collar that may be buttoned or left open, as desired by the wearer, a tie fixed in position on the front portion of the shirt and extending downwardly from the collar of the shirt, thereby providing the illusion of a conventional tie, the tie including respective integral portions which extend beneath the collar of the shirt from the front portion thereof, the tie being printed by "puffed" ink, thereby providing a three-dimensional effect, and the "puffed" ink tie comprising alternate spaced-apart sections separated by the front portion of the shirt, thereby simulating a regimental striped tie.

7. The combination of a dress shirt and a tie, wherein the illusion of a conventional tie is provided, and wherein the illusion is maintained even when the shirt is opened, comprising a conventional dress shirt that may be readily laundered, the shirt having a front portion and further having a neck band portion including a collar that may be buttoned or left open, as desired by the wearer, a tie fixed in position on the front portion of the shirt and extending downwardly from the collar of the shirt, thereby providing the illusion of a conventional tie, the tie including respective integral portions which extend beneath the collar of the shirt from the front portion thereof and at least partially around the neck band portion thereof, thereby maintaining the illusion of a conventional tie even though the collar of the shirt is opened by the wearer, the front portion of the shirt including respective adjacent portions, fastening means including respective hook-and-loop fasteners for holding the respective adjacent portions of the front portion of the shirt together, the fasteners being disposed beneath the tie and being hidden externally of the wearer, thereby avoiding any interference with the tie on the front portion of the shirt, the tie being formed by "puffed" ink, thereby providing a three-dimensional effect, and the "puffed" ink including alternate spaced-apart sections separated by the front portion of the shirt, thereby simulating a regimental striped tie.

* * * * *